US007570138B2

(12) United States Patent
Hirabayashi

(10) Patent No.: US 7,570,138 B2
(45) Date of Patent: Aug. 4, 2009

(54) ELECTROMAGNETIC SWITCH FOR STARTER

(75) Inventor: Takashi Hirabayashi, Chita-gun (JP)

(73) Assignee: Denso Corporation, Kariya (JP)

( * ) Notice: Subject to any disclaimer, the term of this patent is extended or adjusted under 35 U.S.C. 154(b) by 287 days.

(21) Appl. No.: 11/303,950

(22) Filed: Dec. 19, 2005

(65) Prior Publication Data

US 2006/0132268 A1 Jun. 22, 2006

(30) Foreign Application Priority Data

Dec. 20, 2004 (JP) ..... 2004-368133

(51) Int. Cl.
*H01H 51/08* (2006.01)

(52) U.S. Cl. ..... 335/131; 335/126; 335/251; 307/10.6

(58) Field of Classification Search ..... 335/126–131, 335/251; 307/10.6
See application file for complete search history.

(56) References Cited

U.S. PATENT DOCUMENTS 4,540,962 A * 9/1985 Gresley et al. ..... 335/131
5,157,367 A * 10/1992 Itoh et al. ..... 335/126
5,332,926 A * 7/1994 Ueno et al. ..... 307/10.6
5,939,960 A * 8/1999 Godel et al. ..... 335/126
6,049,263 A * 4/2000 Vilou ..... 335/126
6,762,663 B2 7/2004 Andoh et al.
6,888,362 B2 * 5/2005 Eldridge et al. ..... 324/757
7,157,996 B2 * 1/2007 Enomoto et al. ..... 335/132
2004/0169573 A1 9/2004 Andoh et al.

FOREIGN PATENT DOCUMENTS

JP U-2-3631 11/1990
JP U-5-94759 12/1993
JP A 2001-313205 10/2002
JP A 2002-313205 10/2002

* cited by examiner

*Primary Examiner*—Elvin G Enad
*Assistant Examiner*—Bernard Rojas
(74) *Attorney, Agent, or Firm*—Oliff & Berridge, PLC

(57) ABSTRACT

An electromagnetic switch for a starter comprises a current-supply terminal and a vibration absorber configured to absorb vibration imposed on the terminal. The terminal is provided so that one end of the terminal is tightly attached to the switch, and the other end is connected to a cable which supplies electric current to the switch. One end of the terminal is tightly attached to a bobbin wound by an excitation coil to which the current is supplied and the other end protrudes through a molded cover outward to be connected to the cable at a connection port formed in the molded cover. The vibration absorber is, for example, a bent portion of the terminal formed integrally with the terminal itself. One or more flexible members are attached to the terminal to support the terminal within the electromagnetic switch and to seal inner spaces between the terminal and the switch.

10 Claims, 9 Drawing Sheets

ELECTROMAGNETIC SWITCH FOR STARTER

CROSS REFERENCE TO RELATED APPLICATION

The present application is based on Japanese Patent Application No. 2004-368133 filed on Dec. 20 2004, the disclosure of which is incorporated herein by reference.

BACKGROUND OF THE INVENTION

1. Technical Field of the Invention

The invention relates to an electromagnetic switch used in a starter for starting an internal combustion engine mounted on a vehicle and particularly to the electromagnetic switch with a pull-out structure of a lead wiring which supplies an electric current to a solenoid coil incorporated in the switch.

2. Related Art

In general, a combustion engine installed in the vehicle is stared by a dedicated apparatus, called a starter. This starter incorporates an electromagnetic switch, which is turned on whenever the combustion engine is started. A conventional starter switch has a resinous molded cover which encloses a movable contact and a pair of stationary contacts. The conventional starter switch also has a main unit which incorporates various members such as magnetic circuit members having linkage with the solenoid coil (hereinafter referred as an excitation coil). The molded cover is press-fitted to a back end surface of the main unit.

A connector is fitted on an outer back end surface of the molded cover. This connector is wired to the excitation coil either inside or outside the molded cover. In this way, the connector is made to pass the electric current to the excitation coil.

An unexamined Japanese gazette JP-A-2002-313205 describes this kind of electromagnetic switch. This switch has a strip-like-shaped terminal whose base portion is tightly fitted to a coil bobbin and connected to the excitation coil wound around the coil bobbin. The terminal extends along the axial direction of the main unit in the molded cover, penetrates outward through a through-hole formed on the back end surface of the molded cover. A tip portion of the terminal protruded from the molded cover acts as a pull-out connector to a cable. The cable extends from an ignition switch to supply the electric current to the excitation coil.

The molded cover provides a cylindrical connector press-fitted to the protruded tip portion of the terminal. The cylindrical connector encloses the protruded tip portion of the terminal, which is connected to a tip portion of the cable.

In the wiring structure for supplying the electric current to the coil described in the aforementioned gazette, the terminal, whose protruded tip portion acts as the pull-out connector to the cable, is tightly fitted to the bobbin, the bobbin is mounted on the main unit, and the molded cover is press-fitted to the main unit.

In the aforementioned wiring structure for supplying the electric current to the excitation coil, however, there is a difficulty that a vibration of the terminal is not suppressed. The vibration of the terminal is mainly caused by the vibration of the cable supplying the electric current to the excitation coil.

The reasons for the above difficulty are as follows. The terminal is fixed to the bobbin, extended linearly in the axial direction, passed through the through-hole formed on the back end surface of the molded cover, and protruded from the molded cover outward in the axial direction. The protruded tip portion of the terminal therefore acts as the connector to the cable.

In this wiring structure, the protruded tip portion of the terminal from the molded cover is required to have a moderate length so as to be connected to the cable. Therefore the protruded tip portion of the terminal is forced to be vibrated in the axial, radial, and/or circumferential directions by the vibration of the cable, because the cable has a certain vibration mass. Consequently, the base portion of the terminal, fixed to the bobbin is repeatedly stressed. If the longitudinal length of the terminal is prolonged, the vibration mass of the terminal itself cannot be neglected, so that the stress induced by the vibration of the terminal acts on the base portion of the terminal. If vehicles are subjected to stronger vibrations, it is required to cope well with the above explained problem that yields a concentration of the vibration stress on the fixed portion of the terminal to the bobbin.

It may be possible to enlarge or strengthen the terminal, especially the base portion of the terminal, in order to solve the above problem. However, in such an enlarged or strengthened structure, various problems including increases in size and weight of the terminal will arise.

SUMMARY OF THE INVENTION

The present invention, which is made in view of the foregoing problem, has an object to provide an electromagnetic switch for a starter, the electromagnetic switch improving tolerance against a vibration imposed on a current-receiving terminal to an excitation coil arranged in the switch.

To achieve the foregoing object, as one aspect, the present invention provides an electromagnetic switch for a starter comprising; a plunger rod driven by an electro-motive force; an excitation coil generating the electromotive force in response to an electric current to be supplied; a terminal receiving the electric current and supplying the received current to the coil; and a vibration absorber configured to absorb a vibration imposed on the terminal.

Therefore, if a vibration is imposed on the terminal, the vibration absorber operates to absorb the imposed vibration so as to prevent or suppress the vibration, resulting in that the tolerance of the terminal against the vibration can be improved, raising the durability of the electrometric switch.

Preferably, in the above fundamental structure of the invention, as one example, the vibration absorber is composed of a bent portion of the terminal having a strip-like shape providing a longitudinal direction and a thickness direction.

Still, in the above preferred structure, the electromagnetic switch further comprises a bobbin wound by the coil, wherein the bent portion is formed into a crank shape when viewed along the thickness direction and formed to have two bends consist of a first bend and a second bend which are positioned at mutual different positions and the terminal has a base portion which extends from a first position where the terminal is fixed to the bobbin to a second position where the terminal first encounters the first bend.

As another aspect, the present invention provides an apparatus comprising an external connector allowing an electric current pass through from a power supply to the apparatus, and a vibration absorber configured to absorb a vibration imposed on the external connector, wherein in particular the external connector has the vibration absorber. Thus, a vibration imposed on the external connector is absorbed well by the vibration absorber with steadiness.

BRIEF DESCRIPTION OF THE DRAWINGS

Other objects, features and advantages of embodiments will become more apparent from the following detailed description made with reference to the accompanying drawings, in which.

DETAILED DESCRIPTION OF PREFERRED EMBODIMENTS

Embodiments of an electromagnet switch for a starter according to the present invention will now be, described in the following.

Refereeing to FIGS. 1-5, a starter according to an embodiment of the present invention will now be described.

Figure 1:
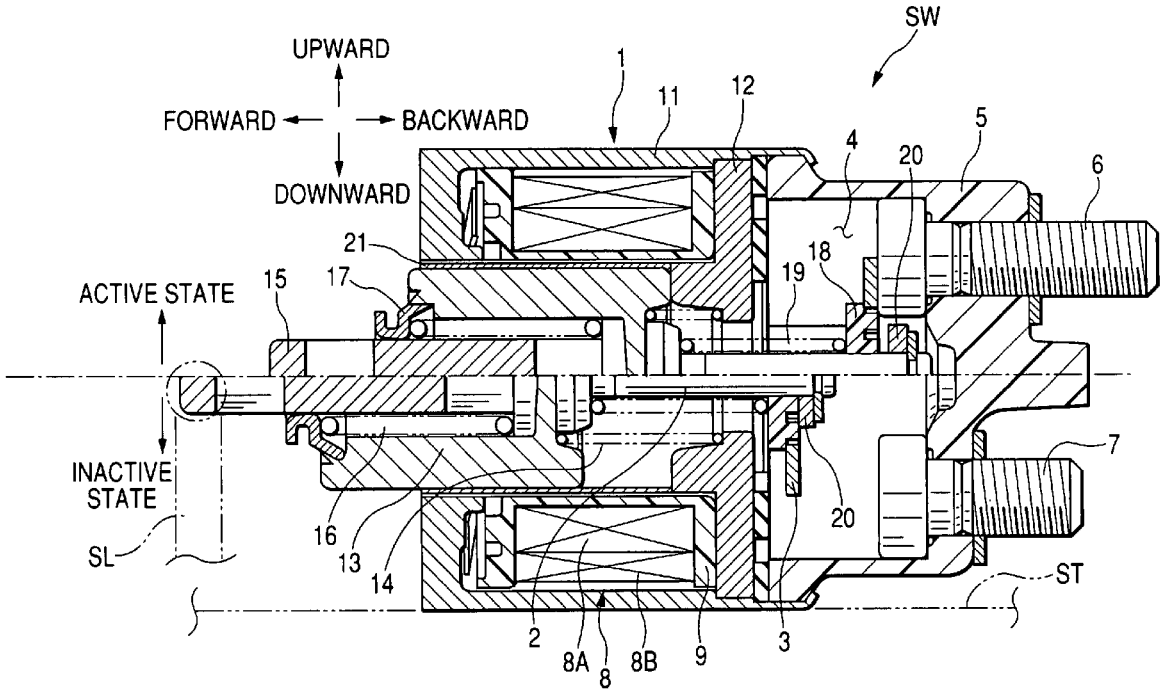
FIG. 1 is an axially cut cross-sectional view of an electromagnetic switch for a starter according to an embodiment of the present invention.

An electromagnetic switch SW according to this embodiment is mounted on a starter ST, as shown in FIG. 1. The switch SW is an apparatus for performing switching control of a power supply powering a motor of the starter and for driving a lever to drive a pinion of the starter ST.

The general structure of the switch will now first be described. FIG. 1 shows a cross sectional view of the switch SW taken along an axial direction thereof. As shown in FIG. 1, the switch SW comprises a main unit 1, which is frequently referred to as a solenoid, and a resinous molded cover 5.

Of these, the main unit 1 comprises a plunger rod 2 and a movable contact member 3 and accommodates the other main members. The molded cover 5 is press-fitted to the main unit 1 with a packing therebetween and is equipped with a contact chamber 4 and a pair of bolt-shaped stationary contact members 6 and 7. The contact chamber 4 is an inner space partitioned by the molded cover 5 and accommodates the movable contact member 3. This movable contact member 3 is formed to extend along the radial direction of the plunger rod 2 and is driven to move, together with the plunger rod 2, in the axial direction of the plunger rod 2.

As a variation, the movable contact member 3 may be provided on the tip portion of the plunger rod 2 opposing the stationary contact members 6 and 7.

An excitation coil 8 is incorporated in the main unit 1. The excitation coil 8 comprises both an attracting coil 8A and a holding coil 8B. Both coils 8A and 8B are wound around a bobbin 9. A magnetic circuit is formed to conduct a magnetic flux generated by the excitation coil 8 operative in response to supplying an electric current thereto. The magnetic circuit is composed of a cylindrical and bottomed yoke 11 which surrounds an outer circumference of the excitation coil 8, a stationary core 12, and the plunger 13 which is also referred to as a movable iron material. The plunger 13 is slidably inserted in an opening formed by an inner circumference surface of the bobbin 9 in the axial direction, with a cylindrical sleeve 21 therebetween. A return spring 14 is provided between the stationary core 12 and the plunger 13 in order to push the plunger 13 forward in the axial direction thereof.

The plunger 13 has a recess formed to open on the frontal end surface thereof. Both of a lever driving rod 15 and a lever spring 16 which pushes the lever driving rod 15 are accommodated in the recess. The base end of the lever spring 16 is hitched on a collar 17 hitched on the front end of the plunger 13, while the pushing end of the lever spring 16 is located to push backward the back end of the lever driving rod 15.

The plunger rod 2 protrudes from the back end surface of the plunger 13 along an axis thereof, extends backward through the stationary core 12 to come into the contact chamber 4. A brush 18 is press-fitted to the tip end (opposing the stationary contact members 6 and 7) of the plunger rod 2 in a movable manner in the axial direction. The movable contact material 3 is tightly fitted to the brush 18 and extends in the radial direction. The brush 18 is pushed backward by the contact spring 19. A washer 20, which functions as a stopper preventing the movable part 3 from moving over the tip of the plunger rod 2, is fixed to the tip portion of the plunger rod 2. In FIG. 1, a reference SL represents a shift lever.

When turning on an ignition key (not shown), supplying the electric current to the excitation coil 8 is started. In response to this current supply, the plunger 13 is attracted backward in the axial direction so that the plunger 13 is retreated from a predetermined initial position, as shown in FIG. 1 (refer to an "inactive state" position in FIG. 1). Simultaneously with the retreat, the return spring 14 is forced to be compressed, together with the retreat of both the plunger rod 2 and the movable contact member 3.

Responsively to this retreat, the plunger 13 is obliged to push the contact spring 19 so as to make this spring 19 progress backward in the axial direction. Finally the plunger 13 stops when it reaches the front end surface of the stationary core 12 (refer to an "active state" position in FIG. 1). The contact spring 19 thus gives press to the movable contact member 3 through the brush 18 so that the member 3 establishes contact to the stationary contact members 6 and 7. This contact leads to turning on the switch SW, and then enables supply of the electric power to the starter motor ST.

When the electric current supply to the excitation coil 8 is turned off after starting of the engine, the magnetic flux generated by the coil 8 is extinguished. In response to this, the plunger 13 is forced to be pushed by the return spring 14 to return to the predetermined initial position. As a result, the movable contact part 3 is disconnected from the pair of stationary contact members 6 and 7, and the electromagnet switch SW is shut down.

A further description about the structure of the main unit 1 will be omitted, because the general structure of this kind of electromagnetic switch are well known. The characteristic part of the electromagnetic switch SW according to the present embodiment is directed to a cantilever type of terminal 100 which is in charge of reception and supply of current to the excitation coil 8. Hence, hereinafter, the description of the terminal 100 will now be focused in connection with FIGS. 2-4. Incidentally, in the same way as the above, the axial and radial directions cited hereinafter are defined as an axial direction and a radial direction of the longitudinal direction of the plunger rod 2 disposed in the switch SW, respectively.

Figure 2:
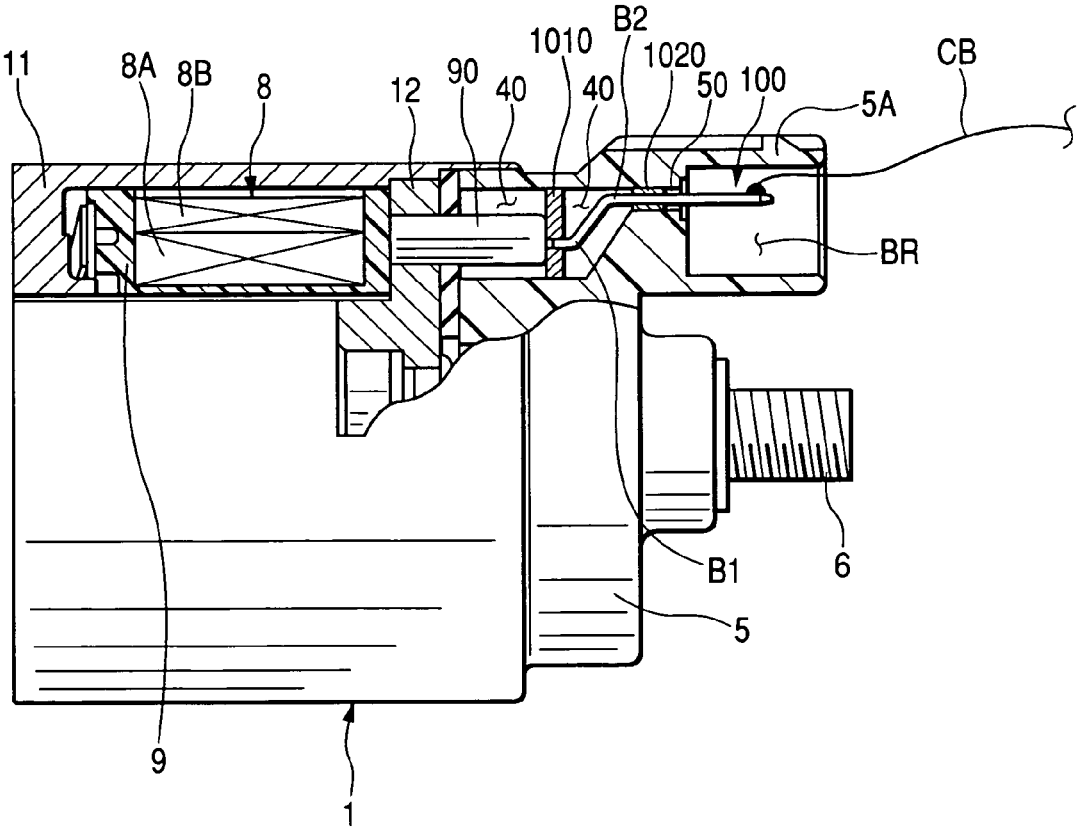
FIG. 2 is a partially cut side view of a main part of the electromagnetic switch, the view being shown by 90 degrees by rotating the view shown in FIG. 1 about a central axis passing the switch in the axial direction.
Figure 4:
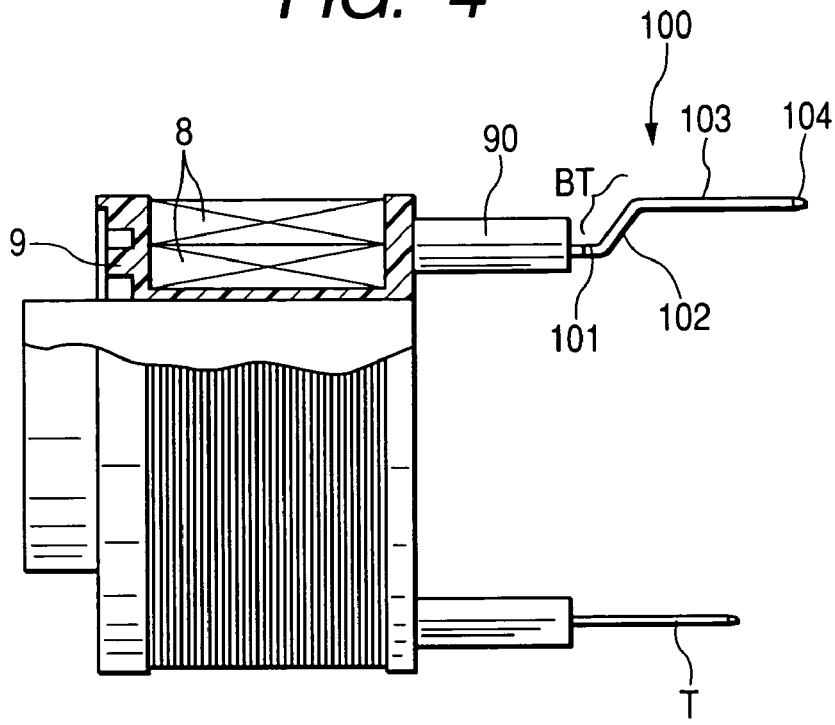
FIG. 4 is a partially cut axial side view of a bobbin, having the terminal fixed thereto and an excitation coil wounded therearound, according to the embodiment.

As shown in FIGS. 2 and 4, as a whole, the terminal 100 is disposed to locate on a radially outward side and to be apart from both of the stationary contact members 6 and 7 by a predetermined distance as shown in FIG. 2. This geometry allows external cables (not shown) to be linked to the terminal 100 and the stationary contact members 6 and 7, separately from each other.

Adjoining to the contact chamber 4, a cavity 40 for accommodating the terminal 100 is formed in the molded cover 5. The terminal 100, which is almost formed in a strip-like shape with an approximately crank-shaped bent portion BT, is coupled with a cylindrical terminal-supporting pillar 90 fixedly arranged to protrude from a backward side surface of the bobbin 9. The terminal-supporting pillar 90 is located at a radially outer position and extends in the axial direction, as shown in FIG. 2, so that the terminal 100 also positions on the radially outer side. Practically, one axial end of the pillar 90 is fixedly inserted into the stationary core 12 in the axial direction and the other end potion is located, as a free end, within a cavity 40 formed at a radially predetermined position, as shown in FIG. 2.

Figure 3A:
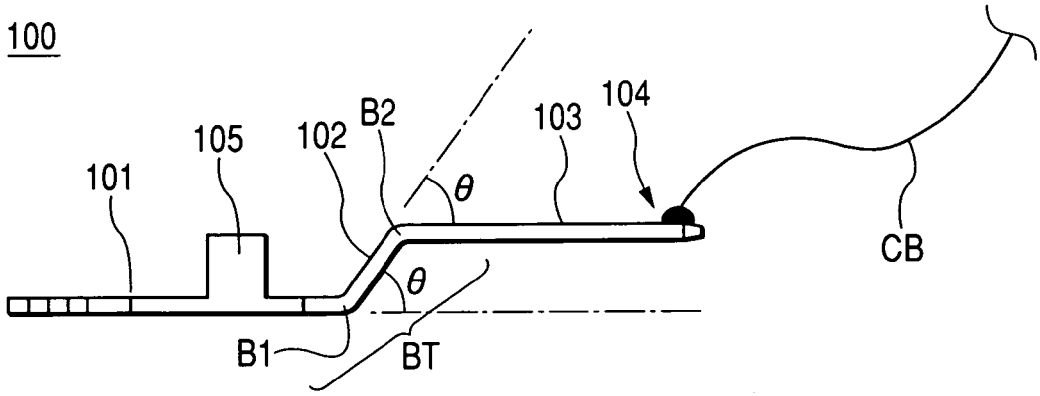
FIG. 3A is a side view of a terminal incorporated in the switch according to the embodiment.
Figure 3B:
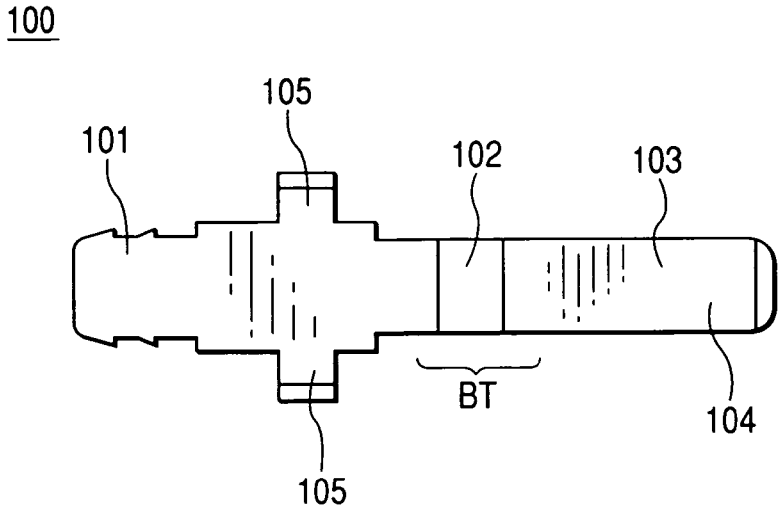
FIG. 3B is a plane view of the terminal.

The terminal 100 has both axial ends, as shown in FIGS. 3A and 3B, one of which is arranged to penetrate through the terminal-supporting pillar 90 therealong to establish an electrical connection with the coil 8 (more specifically, electrical connections with both the attracting coil 8A and the holding coil 8B). The remaining part of the terminal 100, that is a part exposed outside the terminal-supporting pillar 90, is made to protrude from the end of the terminal-supporting pillar 90 in the axial direction.

In addition, as shown in FIG. 2, the molded cover 5 is formed into a bottomed shallow cylindrical shape, so that the cover 5 has a bottom wall on the backward side. The bottom wall is formed to have a cylindrical protective connection port 5A extending from therefrom in the axial direction. This connection port 5A has a bottom integrally formed with the bottom wall and an approximate-dimension bore BR which is open to the outside in the axial direction. A through-hole 50 with an approximately set diameter is formed through the bottom to communicate both the cavity 40 and the bore BR of the connection port 5A. Thus, the remaining part of the terminal 100, which is described above, is arranged to penetrate, through the through-hole 50, the bottom of the connection port 5A and its top of the remaining part is located within the bore BR. This tip is connected with the external cable for an electrical connection, so that the electrical connection obtains protection from external influences.

The cavity 40 is doubly sealed with both first and second flexible members 1010 and 1020, which are made of rubber material or rubber containing specific powder, for example. The first flexible member 1010 is arranged on the backward surface of the terminal-supporting pillar 90 to not only support a fixed end portion of the terminal 100 to the pillar 90 but also seal an axially-bobbin-side space of the cavity 40 partitioned by the member 1010. The position of the first flexible member 1010 is not limited to the above, but may be shifted, in the axial direction, to a position which is nearer to or abutting on a bend 81 (refer to FIG. 2) which will be explained later. In contrast, the second flexible member 1020 is arranged to fill the through-hole 50 for achieving a sealing performance between the cavity 40 and the bore BR of the connection port 5A.

The terminal 100, which is formed into a long strip-like plate made of electrically conductive material, includes, by itself, two bends B1 and B2 formed predetermined longitudinal positions of the terminal 100, as shown in FIGS. 3A and 3B. These two bends B1 and B2 compose a bent portion BT providing a kind of spring functioning as a vibration absorber.

More precisely, the terminal 100 itself is bent twice at two predetermined longitudinal positions thereof in directions oblique to the surface of the terminal 100 so that the two bends B1 and B2 are formed. Thus, these two bends B1 and B2 divide the single terminal 100 into three segments consisting of a base segment 101, an intermediate segment 102, and a tip-side segment 103. Of these segments, the base segment 101 is partly fixed in the terminal-supporting pillar 90, which allows the pillar 90 to support the terminal 100 in the axial direction of the switch SW and to provide the tip 104 of the tip-side segment 103 as a free end. This tip 104 is connected with the external cable CB within the bore BR of the connection port 5A.

In a thickness direction of the terminal 100 perpendicular to the longitudinal direction thereof, the intermediate segment 102 is bent, at a given first longitudinal position of the plate member (i.e., the terminal 100), obliquely to the plate surface of the base segment 101 to form the first bend B1. The tip-side segment 103 is folded back (i.e., bent), at a given second longitudinal position of the plate member which is near to the free end thereof, obliquely to the plate surface of the intermediate segment 102 so that the second bend B2 is formed and the tip-side segment 103 is, for instance, almost in parallel with the base segment 101. The tip-side segment 103 is positioned in the axial direction to extend through the through-hole 50 toward the bore BR of the connection port 5A. The bent angles θ of the bend B1 and B2 (refer to FIG. 3A) are 30-60 degrees, for example, which depends on design of the terminal 100.

From a further point of view, the bends B1 and B2 can be defined as parts of the terminal at which deformation is localized.

As a result, a central portion of the terminal 100, which includes the intermediate segment 102 and the two bend B1 and B2 on both sides of the segment 102, composes the foregoing bent portion BT which works, as mentioned above, as a kind of spring having a spring effect. This spring effect provides flexibility against vibration applied to the tip-side segment 103.

The number of bends, the longitudinal positions of the bends, the bent angles θ of the bends, and the dimensions of the terminal 100 are determined depending on how large spring effect is desired.

In addition, the base segment 101 is partly projected and bent upward (as illustrated in FIG. 3A) on both lateral sides to form connection arms 105. These connection arms 105 are used for electrical connections with lead wires pulled out of the excitation coil 8, so that the excitation coil 8 can electrically be connected with the external cable CB via the terminal 100.

The terminal 100, which is formed as above, is press-fitted into the terminal-supporting pillar 90 of the bobbin 9 as shown in FIG. 4. Then lead wires pulled out from the excitation coil 8 are connected to the connection arms 105, providing a coil assembly. This coil assembly is accommodated into the inside bore of a yoke 11, together with the other members as shown in FIG. 2. The stationary core 12 is then press-fitted into the back-side opening of the yoke 11 so that the opening is charged with the stationary core 12. Thus the back-side opening of the yoke 11 is closed, providing the assembled main unit 1. After this, the molded cover 5 is rigidly coupled to the backward-side end of the yoke 11 and then the back-side end of the yoke 11 is caulked onto the outer surface of the molded cover 5, during which process the tip-side segment 103 of the terminal 100 is adjusted to pass through the foregoing through-hole 50. In this way, the assembly process of the switch is carried out.

Incidentally, in FIG. 4, a reference T depicts a conducting terminal member linked to a crank motor.

Figure 5:
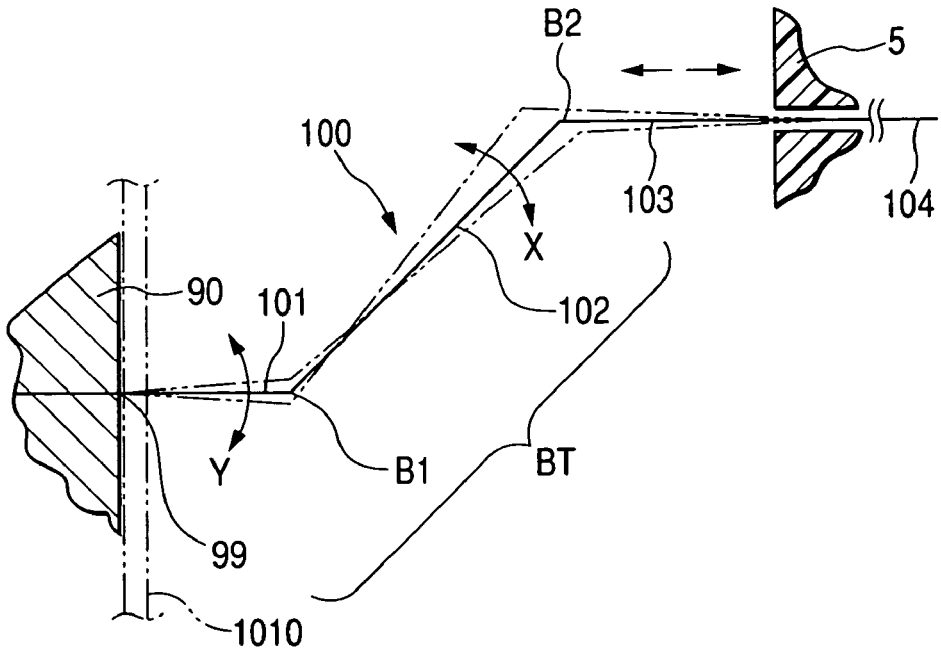
FIG. 5 explains how a bent portion of the terminal works as a vibration absorber in reducing stress induced by vibration to be transmitted to the terminal along the axial direction of the switch in the embodiment.

Referring to FIG. 5, the operations and advantages of the bent portion BT of the terminal 100 will now be detailed.

The primary advantage is to reduce the stress concentration on the terminal-supporting pillar 90, which is achieved by employing the foregoing bent portion BT in the terminal 100.

When vibration is applied to the tip 104 of the tip-side segment 103 of the terminal 100 in the axial direction of the switch SW, the vibration will be transmitted to the intermediate segment 102 and will cause this segment 102 to oscillatory motions in an arch-like direction shown by a reference X in FIG. 5. Those motions along the direction X results in oscillatory motions of the base segment 101 in an arch-like direction shown by a reference Y in FIG. 5. Those oscillatory motions of the base segment 101 are helpful for reduce a direct vibration load (stress) to the terminal-supporting pillar 90 in the axial direction. This owes to the fact that the bent portion BT including both the intermediate segment 102 and the bends B1 and B2 has a kind of spring effect to absorb such vibration applied in the axial direction and vibration applied to include an axial directional vibration component.

Further, if without any means, the oscillatory motions of the base segment 101 in the arch-like direction Y would force a pillar-inserted portion 99 of this segment 101 to resist stress resultant from such oscillatory motions of the segment 101. This stress would be oriented in a thickness direction of the base segment 101. However, in the structure of the present embodiment, the foregoing first flexible member 1010 is arranged at the pillar-inserted portion 99, whereby this flexible member 1010 is able to relieve or absorb the stress to be applied to pillar-inserted portion 99 of the base segment 101.

In addition, thanks to the above functions, the stress concentration on the terminal-supporting pillar 90 on the bobbin 9 can be suppressed well.

As a result, vibration (load) applied in the axial direction or vibration including an axial vibration component can be reduced with effectiveness. Hence the electromagnetic switch SW having enough tolerance against vibrations can be fabricated.

Another advantage comes from the installation of the second flexible member 1020. Since, the bent portion BT including the intermediate segment 102 is located at or near the axial center of the terminal 100, this location sometimes makes it difficult to acquire a stable, precise position of the tip-side segment 103 of the terminal 100, unless the second flexible member 1020 is not installed. In the present embodiment, however, the second flexible member 1020 is installed as described above, so that the member 1020 can be used as a suppressing member toward the tip-side segment 103. This means that suppressing the tip-side segment 103 can adjust a positioning error of the axial tip 104 of the terminal 100 in the radial direction. Therefore the positioning precision can be improved.

Still further, the second flexible member 1020 also effectively absorbs vibration in the perpendicular directions to the axial direction of the terminal 100.

The second flexible member 1020 in the through-hole 50 is able to appropriately seal the cavity 40.

It is also preferred that the electromagnetic switch SW is mounted in a vehicle so that the longitudinal direction of the base portion 101 almost becomes parallel to the horizontal plane presented by a vehicle. In such installation geometry, if necessary, the terminal 100 can be adjusted in its installed attitude by changing the installation angels thereof so that the longitudinal direction of the base portion 101 is almost in agreement with the horizontal plane.

Therefore, compared with the conventional terminal with no above-described bent portion BT or the other countermeasures against vibration, tolerance for the load imposed on the terminal-supporting pillar 90 can be improved more with effectiveness, because the vibration at the pillar-inserted portion 99 of the terminal 100 can be reduced more largely. Generally, vibration imposed on the terminal 100 in the actual use occurs in a substantially vertical direction, because the weight of the power supply cable CB is imposed on the tip 104 of the terminal 100 and vibration generated from the engine during the run of the vehicle operates as a force directed essentially downward in the vertical direction.

In considering the fact that the width of the terminal 100 is designed to be larger than the thickness thereof, making the thickness direction of the terminal 100 agree to the vertical direction when the switch SW is installed into a vehicle provides a further improvement of the vibration tolerance of the base portion 101 of the terminal 100.

According to inventor's findings, it is preferred that the longitudinal axis (direction) of the base portion 101 is kept from −15 degrees to +15 degrees relative to the horizontal plane of a vehicle when the switch SW is mounted in the vehicle.

By the way, any resinous material can be used as a material for the first and second flexible members 1010 and 1020, as long as the resinous material is more flexible than the molded cover 5. The first and second flexible members 1010 and 1020 are designed to effectively absorb the energy of vibration occurring in the thickness direction perpendicular to the surface of the terminal 100, whereby the members 1010 and 1020 are able to reduce not only the stress concentration on the terminal-supporting pillar 90 but also the stress concentration in the pillar-inserted portion 99 of the terminal 100.

It is allowable that at least one of the first and second bends B1 and B2 is moderately bent with a specific radius of curvature. This curved-bent structure also provides the same improvements as those explained above.

Modified Embodiments

Referring to FIGS. 6-12, a variety of types of modified embodiments will now be described hereinafter.

Figure 6:
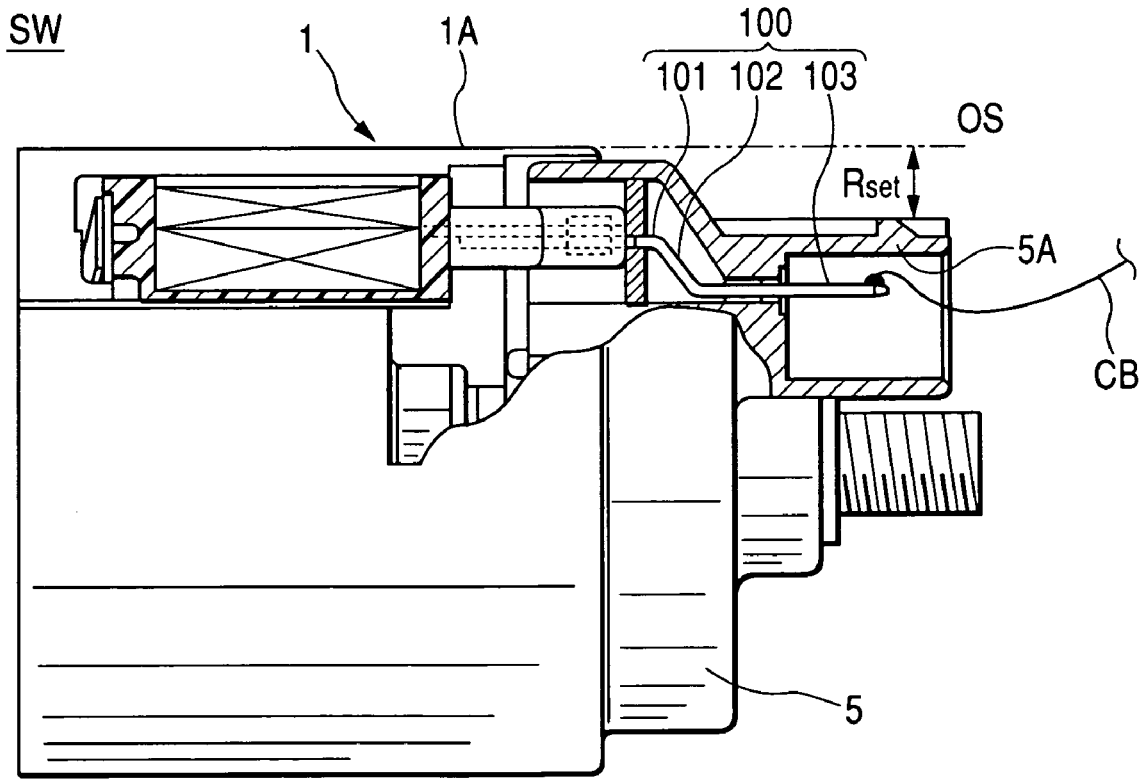
FIG. 6 is a partially cut axial side view of a main part of the electromagnetic switch with a molded cover attached thereto, according to a modification of the embodiment.

Referring to FIG. 6, a first modified embodiment will now be described. This first modified embodiment relates to the radial position of the connection port 5A formed to protrude from the molded cover 5. In the configuration shown in FIG. 2, the bent portion BT of the terminal 100 is formed such that the bent portion BT is directed to extend outwardly in the radial direction of the molded cover 5, thus the radial position of the connection port 5A becomes higher depending on the slope of the intermediate segment 102 of the bent portion BT. But this is not a definitive list about the radial position of the connection port 5A.

For example, as shown in FIG. 6, the intermediate segment 102 may be located so as to have a descendent slope in the radial direction as the position on the terminal 100 goes toward the outside in the axial direction. This arrangement allows the connection port 5A to be positioned closer to the radial center position of the molded cover 5. Hence, compared to a surface OS whose height agrees to the outer surface 1A of the main unit 1, the connection port 5A can be lowered by a reduction Rset in the radial direction. As a whole, the electromagnetic switch SW can be made more compact in the radial size.

Figure 7A:
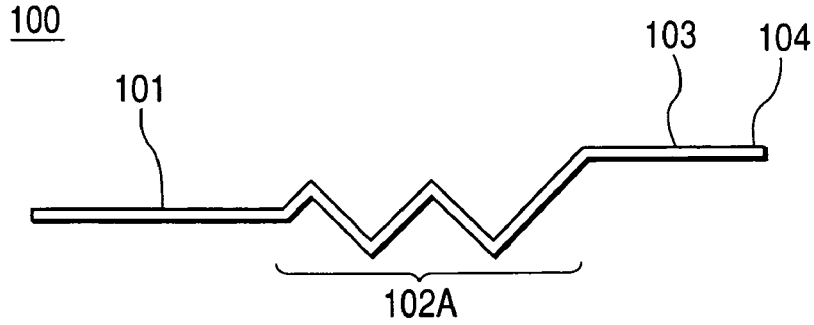
FIGS. 7A-7C are side views of terminals each a serrated-shaped bent portion according to other modifications of the foregoing embodiment, respectively.
Figure 7B:
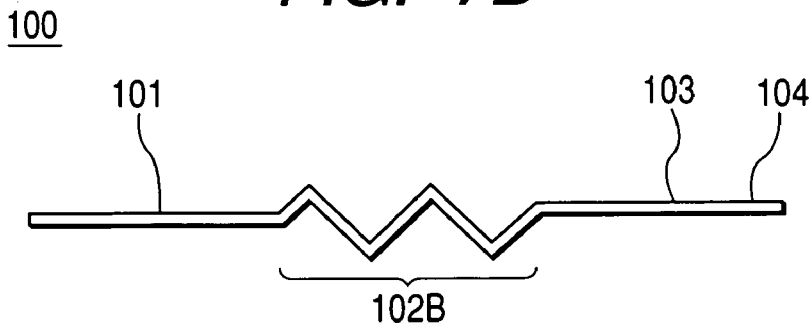
Figure 7C:
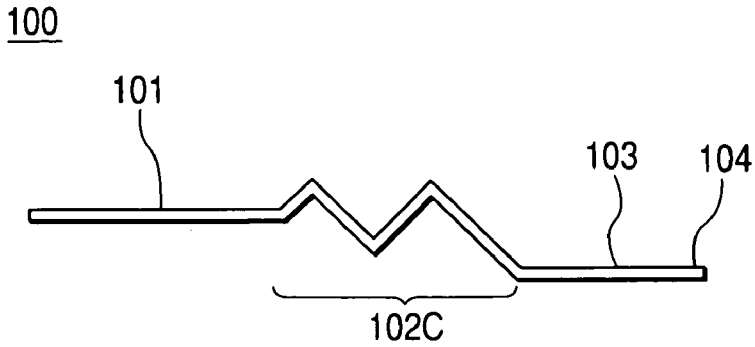

Referring to FIGS. 7A-7C, a second modified embodiment will now be explained. The second modified embodiment is concerned with the side-viewing shape of a bent portion formed in the terminal 100 and the radial position of the axial tip of the terminal 100. In other words, the shape and position of those are not limited to the ones explained in the foregoing embodiment.

As shown in FIGS. 7A-7C, each terminal 100 may have a bent portion 102A (102B, 102C), which is formed into a serrated side-viewing shape consisting of a plurality of serrations. In addition, each of the bent portions 102A, 102B and 102C differ from one another in the position of the axial tip 104 which positions in the radial direction when it is mounted in the switch SW. When being mounted, the terminal 100 shown in FIG. 7A provides the axial tip 104 which is positionally higher than the base segment 101 in the radial direction, that shown in FIG. 7B provides the axial tip 104 which is positionally the same as the base segment 101 in the radial direction, and that shown in FIG. 7C provides the axial tip 104 which is positionally lower than the base segment 101 in the radial direction. Therefore, the various examples shown in FIGS. 7A-7C are able to provide the similar advantages to the foregoing and to widen the freedom of design.

Figure 8A:
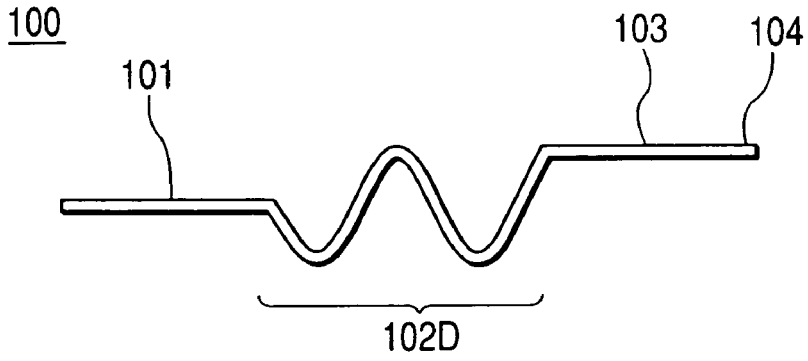
FIGS. 8A-8C are side views of terminals each having a wave-shaped bent portion according to other modifications of the foregoing embodiment, respectively.
Figure 8B:
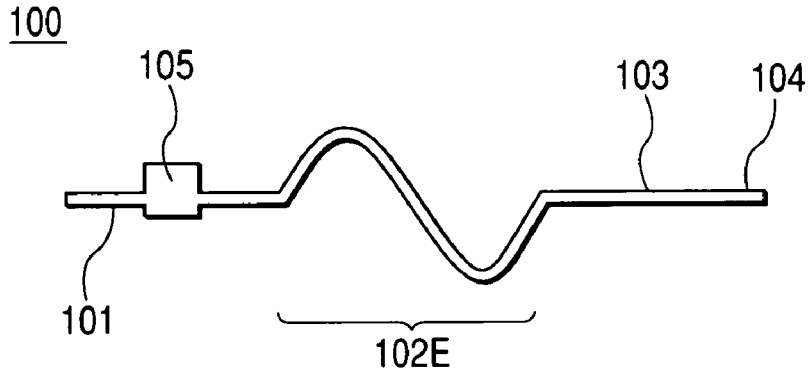
Figure 8C:
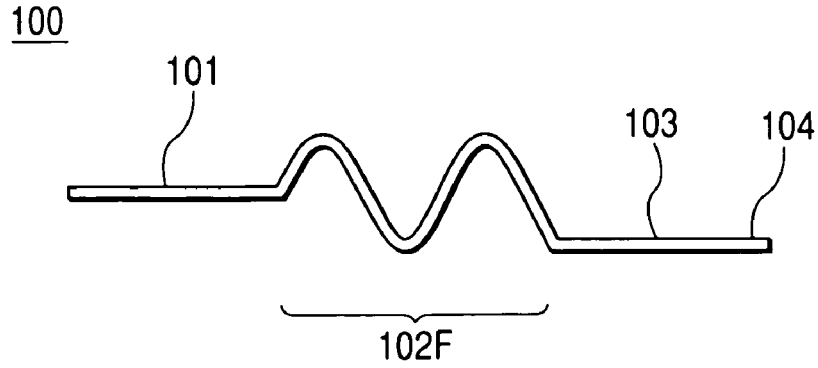
Figure 9:
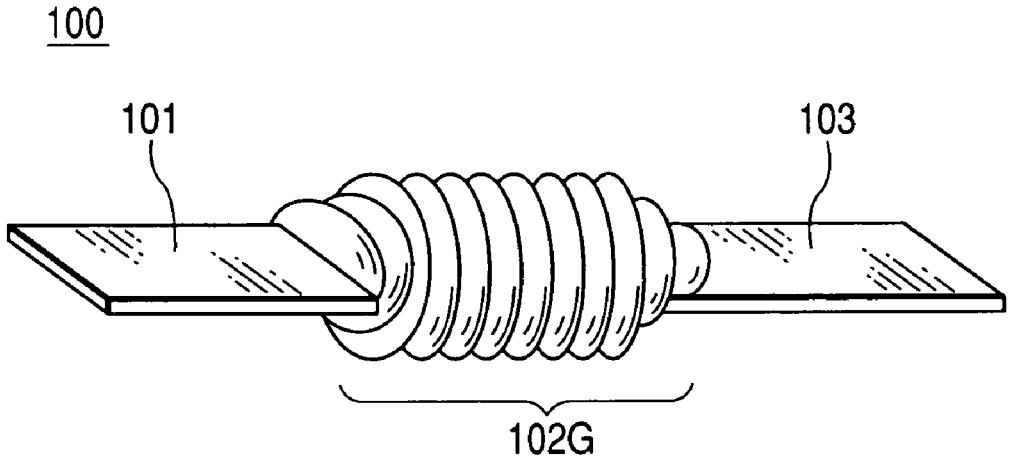
FIG. 9 is a perspective view of a terminal having a bellows-shaped bent portion according to another modification of the foregoing embodiment.
Figure 10:
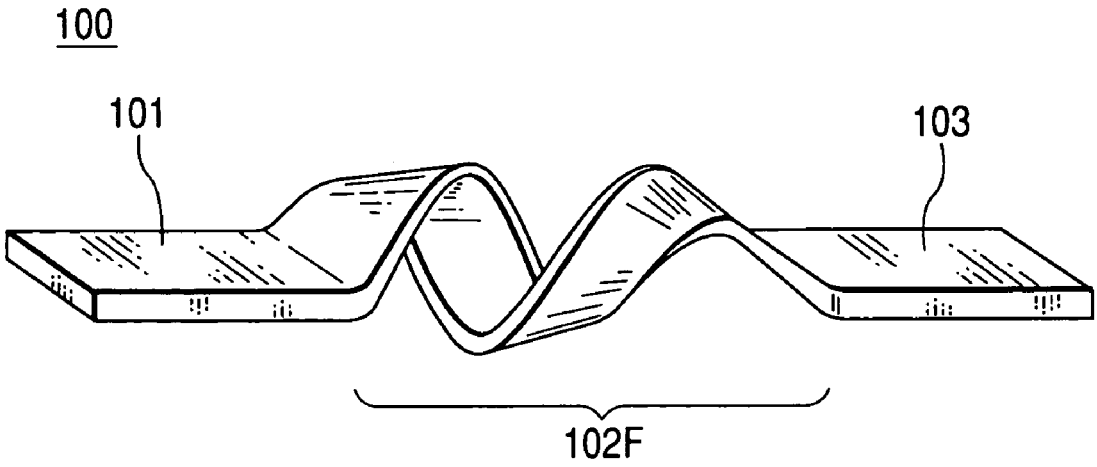
FIG. 10 is a perspective view of a terminal having a twisted portion according to another modification of the foregoing embodiment.

Referring to FIGS. 8A-8C, a third modified embodiment will now be explained. The third modified embodiment is also concerned with the side-viewing shape of a bent portion formed in the terminal 100 and the radial position of the axial tip of the terminal 100.

As shown in FIGS. 8A-8C, each terminal 100 may have a bent portion 102D (102E, 102F), which is formed into a wave-like side-viewing shape consisting of a plurality of rounded waves. In addition, each of the bent portions 102D, 102E and 102F differ from one another in the position of the axial tip 104 which positions in the radial direction when it is mounted in the switch SW. When being mounted, the terminals 100 shown in FIG. 8A-8C provide the axial tip 104*s* which is positionally different from one another in the radial direction, similarly to those shown in FIGS. 7A-7C. Therefore, the various examples shown in FIGS. 8A-8C are also able to provide the similar advantages to the foregoing and to widen the freedom of design.

As other modified embodiments which allow the terminal 100 to have a vibration absorbing function, two further structures may be provided. The structure shown in FIG. 9 employs a bellows-shape vibration absorber 102G, while the structure shown in FIG. 10 employs a twisted type of vibration absorber 102F. Both the vibration absorber 102G and 102F are also able to have spring effect which absorb vibration to be applied.

Figure 11:
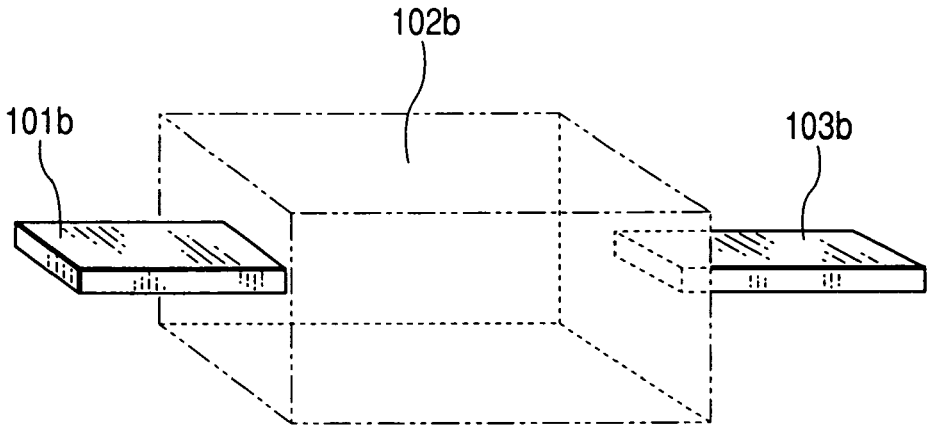
FIG. 11 is a conceptual perspective view of a terminal having a vibration-absorbing portion.
Figure 12:
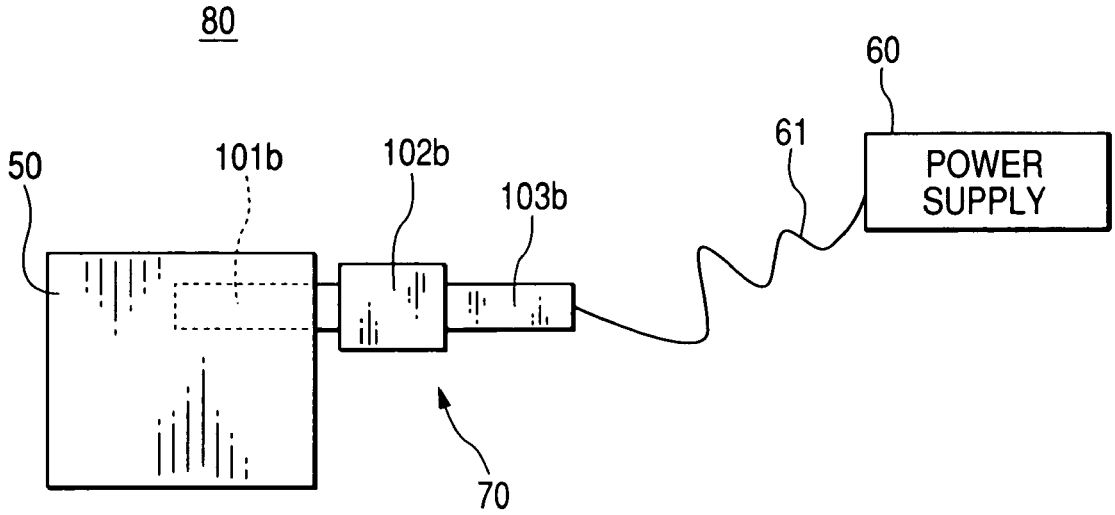
FIG. 12 is a conceptual illustration of an apparatus having a current-receiving terminal with a vibration absorber.

Referring to FIGS. 11 and 12, a further modified embodiment will now be explained. This modified embodiment concerns with a more generalized application in which the present invention is reduced into practice.

The most conceptual form of the terminal 100 according to the present invention is shown in FIG. 11, in which the terminal 100 is composed of electrically-conductive segments 101*b*, 102*b* and 103*b*and the intermediate segment 102*b* functions as a vibration absorber. As this vibration absorber 102*b*, i.e., the intermediate segment 102*b*, any type of bend or member that has been described above can be used.

This terminal structure shown in FIG. 11 can be applied to an electric apparatus 80 that involves a cantilevered current-receiving terminal 70 one end of which is fixed into a main unit 50 of the apparatus 80 and the other end of which is a free end. In this configuration, the terminal 70 can be formed by using the terminal structure shown in FIG. 11. The tip-side segment 103*b* is eclectically connected to a power supply via a cable 61. Hence, even if this apparatus 80 is used in an environment with much vibration and the cable transmits the vibration to the terminal 70, the intermediate segment 102*b* provides a vibration absorbing function, with the result that the same or similar advantages as or to the foregoing can be obtained, raising durability of the apparatus.

It should be noted that the scope claimed for the invention, as set out in the appended claims, is not limited to the foregoing embodiments, and possible alternations or variations of the concepts of these embodiments with other known technical features to produce the electromagnetic switch would be within the scope of the invention.

What is claimed is:

1. An electromagnetic switch for a starter, the electromagnetic switch comprising:

a plunger rod driven by an electro-motive force;

an excitation coil generating the electro-motive force in response to an electric current to be supplied;

a cantilever-type terminal having a fixed end and a free end and formed from a flat conductor defining a longitudinal direction and a thickness direction of the terminal, the terminal receives the electric current, and supplies the received electric current to the excitation coil, the terminal including a vibration absorber which is configured to absorb a vibration imposed on the free end of the terminal, the vibration absorber is a bent portion of the terminal located between the free end and the fixed end of the terminal;

a bobbin wound by the coil, wherein the bent portion has a crank shape when viewed along the thickness direction and has two bends consisting of a first bend and a second bend which are positioned at mutual different positions, and the terminal has a base portion which extends from a first position where the terminal is fixed to the bobbin to a second position where the terminal first encounters the first bend, wherein the bends are obliquely bent relative to the longitudinal direction;

a molded cover which encloses one end of the plunger rod and has a wall;

a through-hole formed in the wall; and a first flexible member attached to the terminal within the through-hole.

2. The electromagnetic switch according to claim 1, wherein the bent portion has a serrated-shape when viewed along the thickness direction.

3. The electromagnetic switch according to claim 1, wherein the bent portion has a bellows-shape when viewed along the longitudinal direction.

4. The electromagnetic switch according to claim 1, wherein the bent portion has a twisted shape around the longitudinal direction.

5. The electromagnetic switch according to claim 1, wherein the bent portion has a wave-like shape when viewed along the thickness direction.

6. The electromagnetic switch according to claim 1, wherein the molded cover further comprises a cavity adjacent to the through-hole for accommodating the base portion and the bent portion.

7. The electromagnetic switch according to claim 6, further comprising a second flexible member tightly attached between the base portion and the molded cover so as to support the terminal.

8. The electromagnetic switch according to claim 1, wherein the base portion is disposed with a specific spacing from a circumferential surface of the plunger rod, passes through the through-hole, and linearly protrudes outwardly from the molded cover in the longitudinal direction.

9. The electromagnetic switch according to claim 8, wherein the first bend is bent outwardly in a radial direction of the plunger rod.

10. The electromagnetic switch according to claim 8, wherein the first bend is bent inwardly in a radial direction of the plunger rod.

* * * * *